United States Patent [19]

Mumm et al.

[11] Patent Number: 4,997,172

[45] Date of Patent: Mar. 5, 1991

[54] JOIST POSITIONING TOOL

[76] Inventors: Richard A. Mumm, P.O. Box 9456; William M. Stamey, III, 21 Killian Rd., both of Asheville, N.C. 28815

[21] Appl. No.: 504,405

[22] Filed: Apr. 4, 1990

[51] Int. Cl.[5] ..... B25B 1/00

[52] U.S. Cl. ..... 269/3; 7/164; 269/904; 254/21; 254/25

[58] Field of Search ..... 254/21, 25, 120, 131; 269/3, 41, 904, 910; 7/164, 166

[56] References Cited

U.S. PATENT DOCUMENTS

| | | | |
|---|---|---|---|
| 117,677 | 8/1871 | Pfouts | 7/164 |
| 1,430,497 | 9/1922 | Engberg | 254/25 |
| 2,616,319 | 11/1952 | Le May | 269/3 |
| 4,926,537 | 5/1990 | Pool | 254/21 |

*Primary Examiner*—J. J. Hartman

*Attorney, Agent, or Firm*—Leon Gilden

[57] ABSTRACT

A tool organization is set forth for positioning and engaging a joist in relationship to a predetermined orientation relative to a cross joint utilized in construction to arrange and orient the first joist in a vertical orientation. The tool comprises a bifurcated head including an internally threaded boss at a rear terminal end thereof to threadedly receive a handle thereon to permit selective replacement of the head to accommodate various width joists. Legs of the head include planar parallel confronting faces and rearwardly tapered side surfaces to effect clearance and enhance visualization in use of the tool. A modification of the instant invention includes a cross shaft mounted to a rear terminal end of the handle, including spirit level and a series of notches mounted on a top surface of the cross shaft. The notches are cooperative with a spool supporting a plumb level, wherein the series of notches accommodate various head widths of the tool as the plumb level is directed in a spaced adjacent relationship relative to the tool.

2 Claims, 5 Drawing Sheets

PRIOR ART

FIG 8
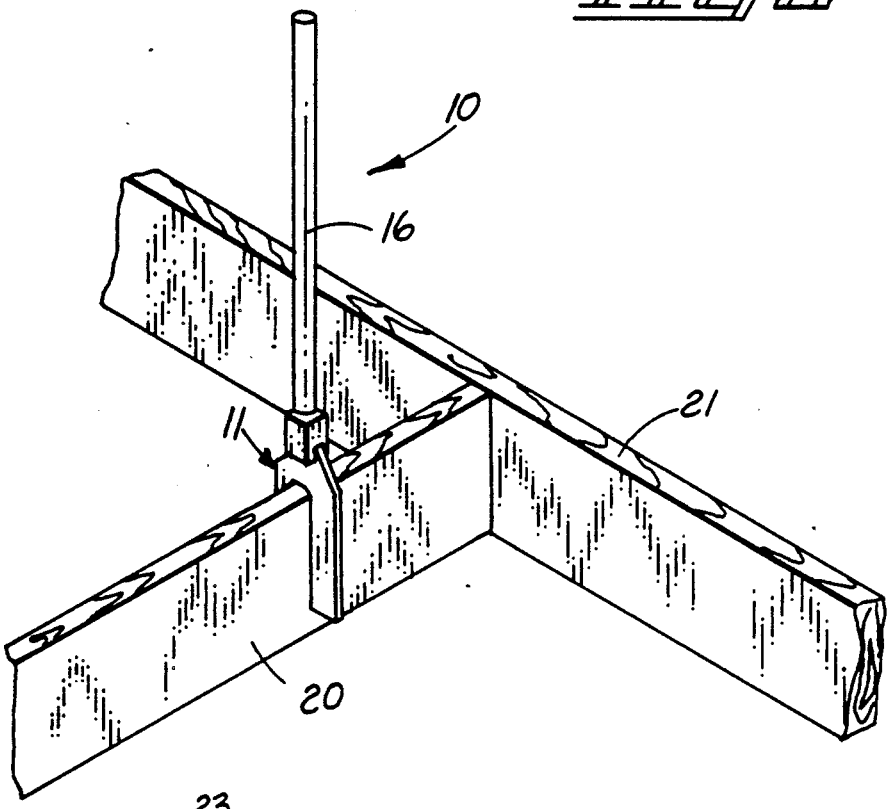
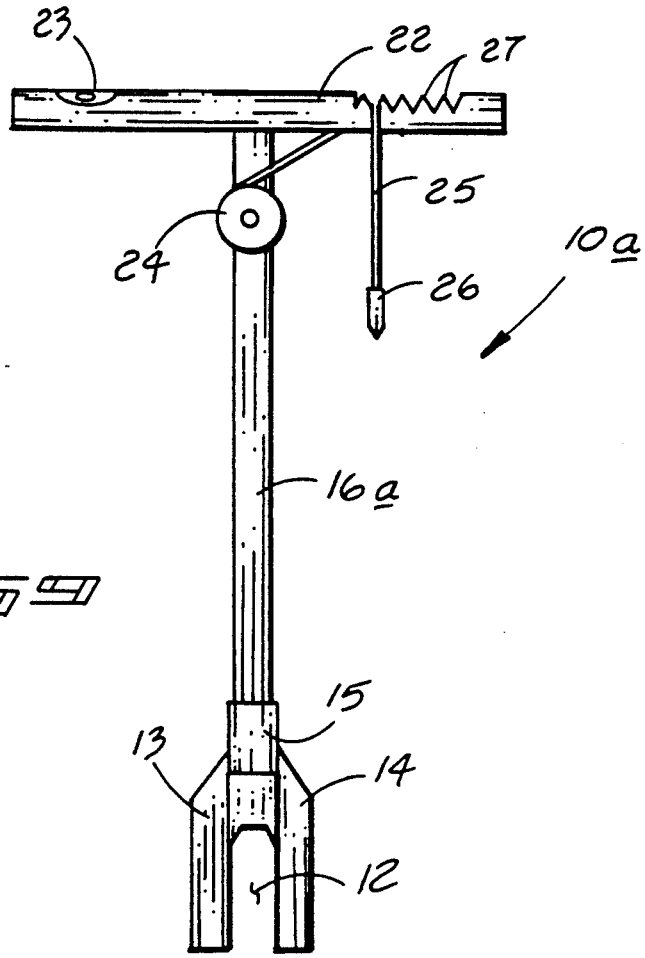
FIG 9

23
22
27
24
25
16
11
13
14
20
26

JOIST POSITIONING TOOL

BACKGROUND OF THE INVENTION

1. Field of the Invention

The field of invention relates to joist construction, and more particularly pertains to a new and improved joist positioning tool wherein the same permits manual positioning and alignment of a joist relative to a cross joist to permit a predetermined alignment of the joist prior to securement of the two joists.

2. Description of the Prior Art

In the positioning and alignment of orthogonally oriented joists and the like for use in construction of various floors, walls, and ceiling members, misalignment of cross joists skewers and disorients the joints providing a misaligned relationship of nailing side surfaces prior to mounting of various additional structures thereon, as well as providing for a properly aligned relationship with a relative joist. Tools utilized in the prior art to clamp and engage joists have typically been of a cumbersome and elaborate construction minimizing their utilization in a construction situation due to the time consuming effort in their use. Examples of the prior art include U.S. Pat. No. 4,836,517 to Vossler wherein a generally "U" shaped frame cooperates with a rectangular shaped frame for attachment to a rafter and the like of a roof, wherein plural clamps mount various cross joists of the roof construction for proper alignment.

U.S. Pat. No. 3,663,004 to Hupert utilizes spaced clamps mounted to an elongate handle to clamp and engage orthogonally oriented construction studs.

U.S. Pat. No. 4,322,064 to Jarvis sets forth a spacing tool utilized in roof construction, wherein the tool includes spaced jaws to engage rafter portions of a roof construction to align the rafters prior to their being fixed together in a completed structure.

U.S. Pat. No. 4,485,543 to Flores, Jr., et al. sets forth a wallboard positioning apparatus utilizing individual clamps to engage a vertical wall stud and the wallboard mounted against the studs to position the wallboard against the aforenoted studs.

U.S. Pat. No. 4,795,141 to Mulvaney sets forth a cam locking stud fixture, wherein spaced jaws are provided to clamp a stud therebetween with fixed upper jaws positioned to receive and stabilize a board during a nailing procedure end-wise to another board.

As such, it may be appreciated that there continues to be a need for a new and improved joist positioning tool wherein the same addresses both the problems of ease of use, as well as effectiveness in construction to properly align a joist prior to a nailing procedure and in this respect, the present invention substantially fulfills this need.

SUMMARY OF THE INVENTION

In view of the foregoing disadvantages inherent in the known types of alignment tool now present in the prior art, the present invention provides a joist positioning tool wherein the same positions and aligns a joist in a predetermined vertical relationship prior to securement and nailing of the joist to a further joist member. As such, the general purpose of the present invention, which will be described subsequently in greater detail, is to provide a new and improved joist positioning tool which has all the advantages of the prior art alignment tools and none of the disadvantages.

To attain this, the present invention includes a tool organization setting forth the positioning and engaging of a joist in relationship to a predetermined orientation relative to a cross joist utilized in construction to arrange and orient the first joist in a vertical orientation. The tool comprises a bifurcated head including an internally threaded boss at a rear terminal end thereof to threadedly receive a handle thereon to permit selective replacement of the head to accommodate various width joists. Legs of the head include planar parallel confronting faces and rearwardly tapered side surfaces to effect clearance and enhance visualization in use of the tool. A modification of the instant invention includes a cross shaft mounted to a rear terminal end of the handle, including spirit level and a series of notches mounted on a top surface of the cross shaft. The notches are cooperative with a spool supporting a plumb level, wherein the series of notches accommodate various head widths of the tool as the plumb level is directed in a spaced adjacent relationship relative to the tool.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved joist positioning tool which has all the advantages of the prior art alignment tools and none of the disadvantages.

It is another object of the present invention to provide a new and improved joist positioning tool which may be easily and efficiently manufactured and marketed.

It is a further object of the present invention to provide a new and improved joist positioning tool which is of a durable and reliable construction.

An even further object of the present invention is to provide a new and improved joist positioning tool which is susceptible of a low cost of manufacture with regard to both materials and labor, and which accordingly is then susceptible of low prices of sale to the consuming public, thereby making such joist positioning tools economically available to the buying public.

Still yet another object of the present invention is to provide a new and improved joist positioning tool which provides in the apparatuses and methods of the prior art some of the advantages thereof, while simultaneously overcoming some of the disadvantages normally associated therewith.

Still another object of the present invention is to provide a new and improved joist positioning tool wherein the same effectively and readily engages opposed sides of a joist to permit securement and alignment of the joist prior to fixedly nailing a joist to a further joist member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of the tool of the instant invention in use.

FIG. 9 is an orthographic side view, taken in elevation, of a modification of the instant invention.

DESCRIPTION OF THE PREFERRED EMBODIMENT

Figure 1:
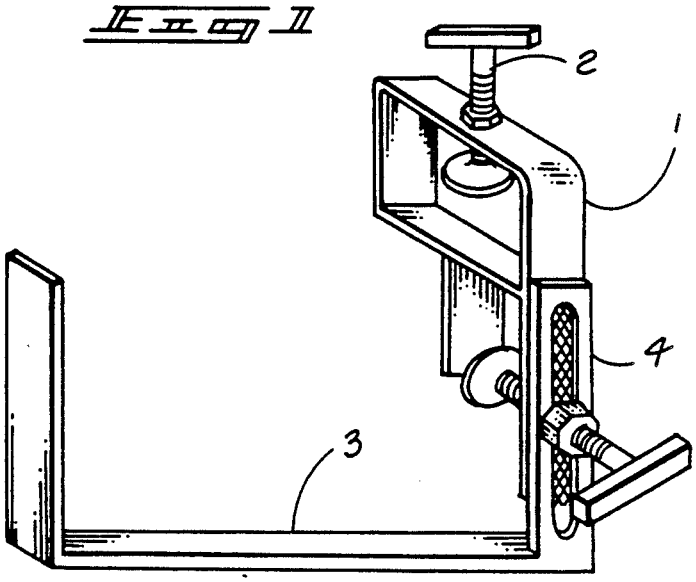
FIG. 1 is an isometric illustration of a prior art positioning tool.

With reference now to the drawings, and in particular to FIGS. 1 to 10 thereof, a new and improved joist positioning tool embodying the principles and concepts of the present invention and generally designated by the reference numerals 10 and 10*a* will be described.

Figure 2:
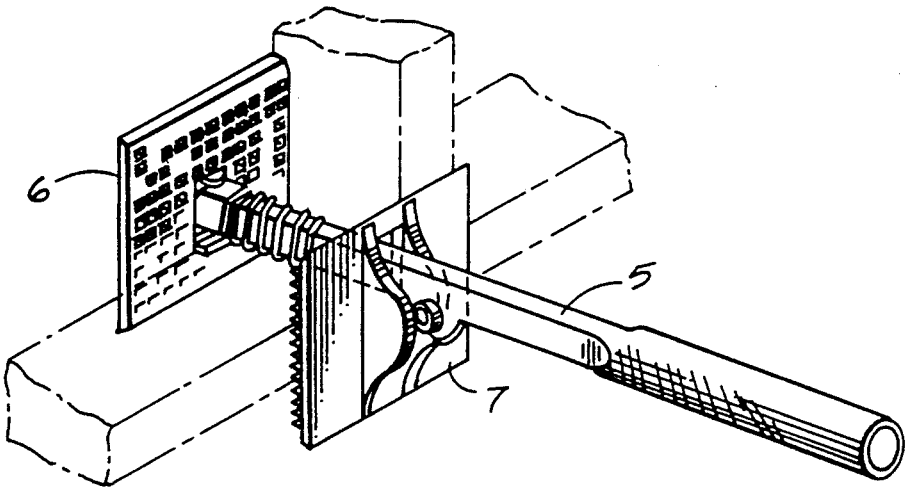
PRIOR ART FIG 2
FIG. 2 is an isometric illustration of a further prior art positioning tool.
Figure 3:
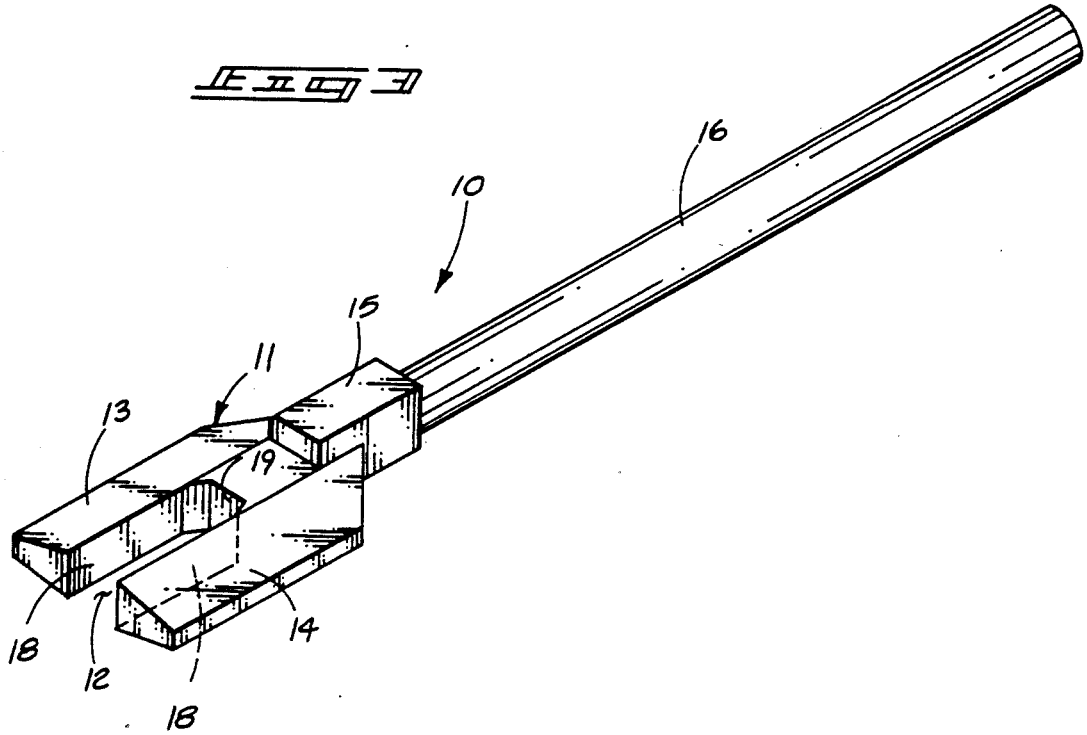
FIG. 3 is an isometric illustration of the instant invention.
Figure 4:
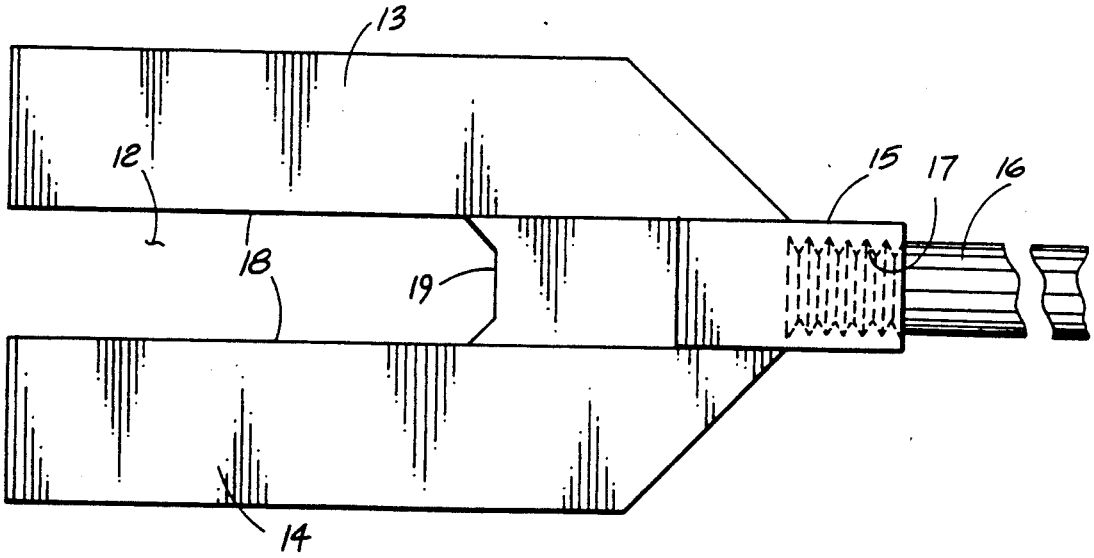
FIG. 4 is a top orthographic view of the bifurcated head of the instant invention.
Figure 5:
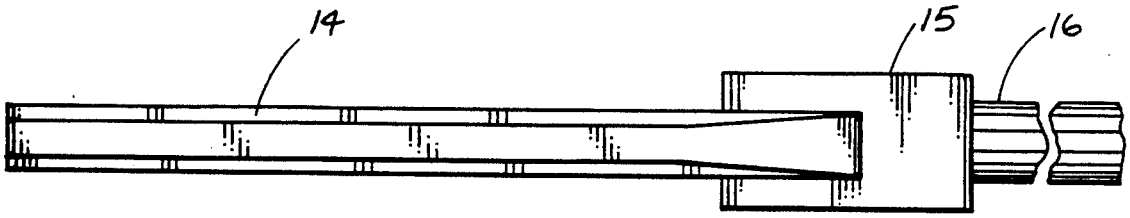
FIG. 5 is an orthographic side view, taken in elevation, of the bifurcated head of the instant invention.
Figure 6:
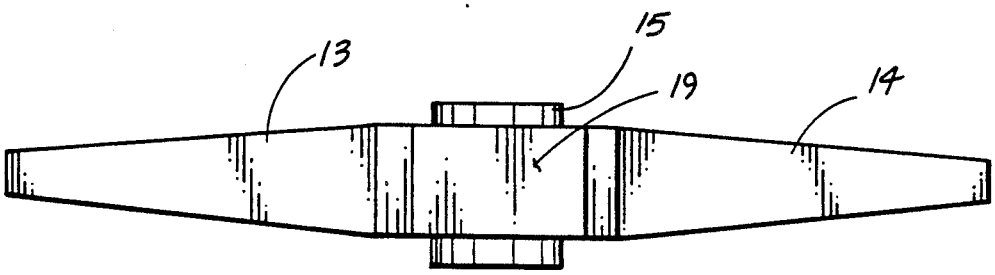
FIG. 6 is an orthographic lower end view of the bifurcated head of the instant invention.
Figure 7:
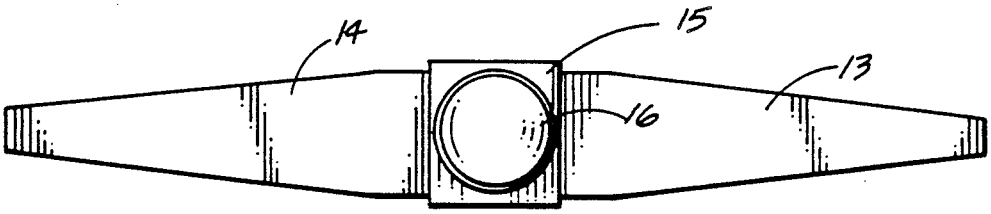
FIG. 7 is an orthographic top end view of the tool of the instant invention.

FIG. 1 illustrates a prior art positioning tool type fixture, wherein the same utilizes a looped rectangular member 1, including a clamp 2 to receive a first joist member therethrough, with a lower "U" shaped frame member 3 including a connecting leg member 4 to associate the "U" shaped member to the member 1 to secure a further joist therewithin to position the plurality of joists relative to each other. FIG. 2 illustrates a further prior art positioning tool, wherein a first and second respective plurality of removable jaws 6 and 7 receive and clamp a plurality of orthogonally oriented joists between the jaws, wherein a handle fixture 5 mounts the removable jaw relative to the fixed jaw 6.

More specifically, the joist positioning tool 10 of the instant invention essentially comprises a bifurcated head 11 defined by a slot 12 of a generally parallelepiped configuration, including a concave rear surface 19 of the slot 12. The concave rear surface 19 minimizes locking engagement of a joist received within the slot 12. A first leg 13 is spaced from a second leg 14 within the head 11, wherein each leg is defined by a generally trapezoidal cross-sectional configuration including top and bottom rearwardly sloping sides to enhance visual observation of a joist contained within the slot 12. The slot 12 is defined by parallel planar surfaces 18 in confronting and parallel relationship relative to one another and formed within interior surfaces of the legs 12 and 13 defining the slot 12. An internally threaded boss 15 is fixedly mounted in alignment with the slot 12 at a rear end of the head 11 to threadedly receive a longitudinally aligned handle 16 formed with a forward threaded end 17. Reference to FIG. 8 illustrates the tool 10 securing a first joist 20 relative to a second joist 21 and to permit manipulation of the first joist prior to its securement relative to the second joist 21 by nailing and the like. It is further understood that the bifurcated handle 11 is threadedly removable from the handle 16 to permit utilization of various heads 11 defining slots 12 of various widths to accommodate various joists therebetween.

Figure 10:
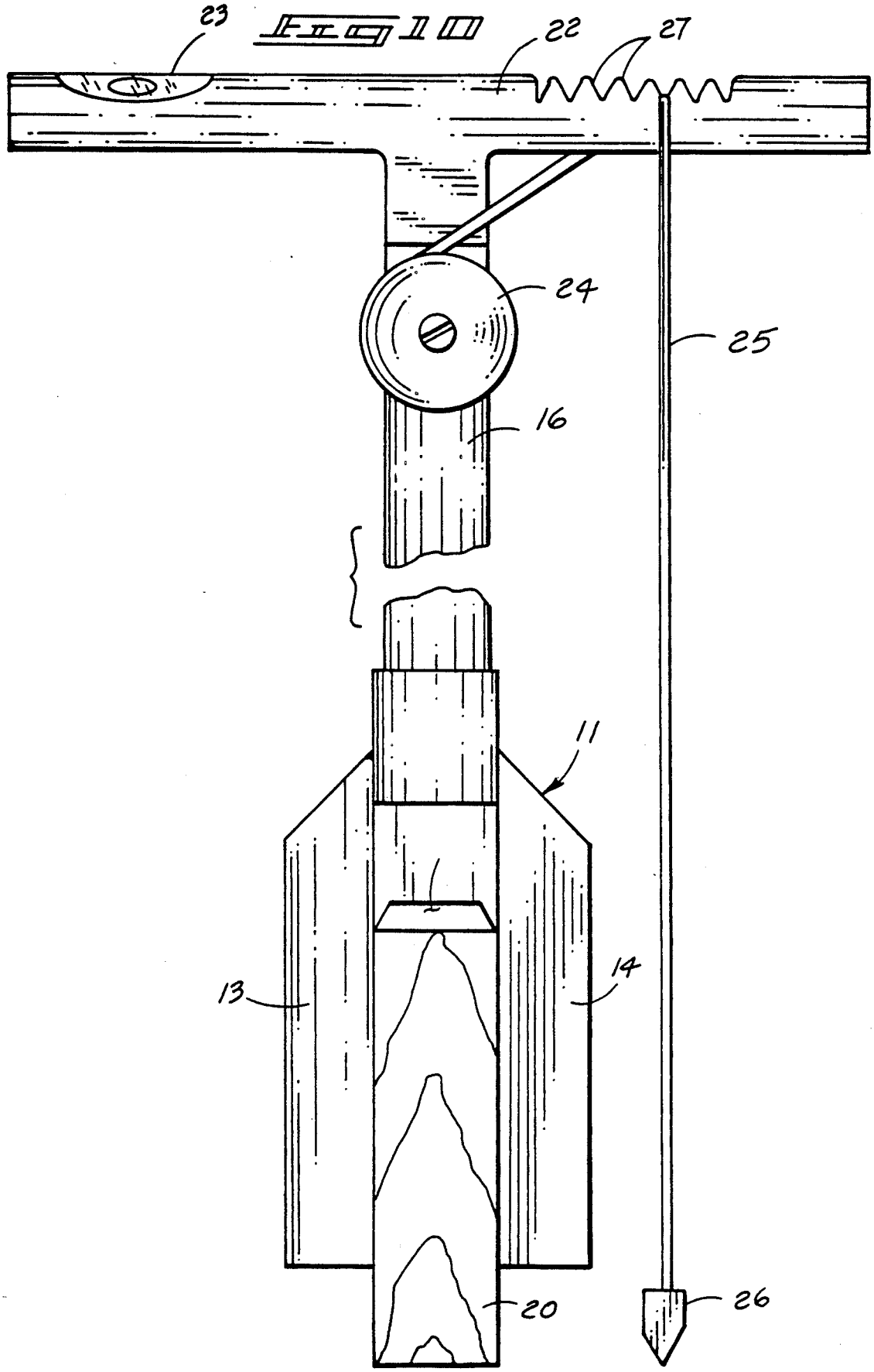
FIG. 10 is an orthographic view of the instant invention, taken in elevation, in association with an associated joist.

FIGS. 9 and 10 illustrate a modified joist positioning tool 10*a* wherein the handle is defined as a modified handle 16*a* formed with a cross shaft 22 fixedly and orthogonally mounted to a rear terminal end of the handle 16*a* medially of the cross shaft 22. The cross shaft includes a spirit level 23 formed within the cross shaft 22 through a top surface thereof adjacent a first end of the cross shaft, wherein the remote second end of the cross shaft includes a series of notches 27 aligned with the spirit level 23. The top surface of the cross shaft 22 is arranged in a diametrically opposed relationship relative to the bottom surface of the cross shaft 22 receiving the handle 16*a* in a fixed relationship thereto. A spool 24 is mounted orthogonally on the handle 16*a* adjacent the cross shaft 22 and mounts a predetermined length of flexible line 25, wherein the flexible line 25 mounts a plumb bob weight 26 formed with a conical tip at its forward free end. Accordingly, (see FIG. 10) in receiving a joist 20 within the bifurcated head 11, the spirit level 23, as well as the plumb bob weight 26, is utilized in providing desired alignment of the joist 20. The series of notches 27 permit spacing of the plumb bob weight 26 relative to the head 11 dependent upon the size of the head 11 utilized to accommodate various joists 20 of various widths encountered in construction.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A joist positioning tool comprising, in combination, a bifurcated rigid head, the head defining a slot directed through a forward end of the head, and the head defining a rear end including an internally threaded boss, the internally threaded boss aligned with the slot and projecting rearwardly of the rear end of the bifurcated head, and an elongate longitudinally aligned handle threadedly received within the threaded boss to permit selective placement of the bifurcated head, and wherein the slot is defined by a parallelepiped configuration throughout its extend, and includes a concave rear end surface defining a rearwardmost extent of the slot, and wherein the bifurcated head includes a first leg and a second leg, the first leg and second leg define the slot therebetween, wherein each leg includes a slot planar surface, wherein each planar surface is arranged parallel to one another, and each leg includes a rearwardly tapering top and bottom side surface defining a trapezoidal cross-sectional configuration of each leg, and wherein the handle includes a cross shaft integrally and orthogonally mounted at a rear terminal end of the handle, wherein the handle bisects the cross shaft, and wherein the cross shaft includes a top surface and a bottom surface, the top surface diametrically opposed to the bottom surface and the bottom surface integrally mounting the handle thereto, and the top surface including a spirit level mounted therewithin adjacent a first end of the cross shaft, and wherein the cross shaft includes a second end spaced from the first end, and the second end includes a series of aligned notches mounted within the top surface aligned with the spirit level.

2. A tool as set forth in claim 1 further including a spool, the spool orthogonally mounted to the handle adjacent the cross shaft, and the spool mounting a predetermined length of flexible line thereabout, the flexible line including a plumb bob weight mounted at a free terminal end of the line, the plumb bob weight terminating in a conical tip spaced from the line, and the line selectively received within one of said notches to position the plumb bob weight adjacent the head for alignment of the head relative to a joist received within the slot.

* * * * *